United States Patent [19]

Ottrok

[11] Patent Number: 4,671,868

[45] Date of Patent: Jun. 9, 1987

[54] METHOD FOR RECOVERING GOLD, PLATINUM OR SILVER FROM AN ORE CONTAINING GOLD DUST, PLATINUM DUST OR SILVER DUST

[76] Inventor: Leo Ottrok, 2750 Lincoln Blvd., Oroville, Calif. 95965

[21] Appl. No.: 526,084

[22] Filed: Aug. 24, 1983

[51] Int. Cl.[4] ..... B07B 13/00

[52] U.S. Cl. ..... 209/48; 209/49; 209/178; 209/447

[58] Field of Search ..... 209/47–50, 209/64, 178, 182, 447, 446

[56] References Cited

U.S. PATENT DOCUMENTS

| | | | |
|---|---|---|---|
| 32,115 | 4/1861 | Brock | 209/447 |
| 668,643 | 2/1901 | Hicks | 209/178 |
| 780,529 | 1/1905 | Rossman | 209/178 |
| 1,192,945 | 8/1916 | Sherwood | 209/178 |
| 1,494,071 | 5/1924 | Marsh | 209/48 |
| 1,972,645 | 9/1934 | Danills | 209/447 |
| 2,178,390 | 10/1939 | Boekel | 209/447 |
| 4,162,969 | 7/1979 | Lagol | 209/447 |

*Primary Examiner*—Charles Hart

[57] ABSTRACT

A method of recovering gold from an ore containing micron gold or gold dust is disclosed. The gold is recovered by providing a silver coated surface, coating the silver coated surface with mercury, washing a mixture of ore and water over the mercury such that an amalgam of gold and mercury is created on the silver coated surface, removing the amalgam from the silver coated surface, and heating the amalgam. The same method may be used to recover platinum from an ore containing micron platinum or platinum dust and also to recover silver from an ore containing micron silver or silver dust.

6 Claims, 3 Drawing Figures

METHOD FOR RECOVERING GOLD, PLATINUM OR SILVER FROM AN ORE CONTAINING GOLD DUST, PLATINUM DUST OR SILVER DUST

BACKGROUND OF THE INVENTION

There are three standard milling procedures for separating gold from its ores: flotation, amalgamation and cyanidation.

In the flotation process, particles of finely ground ore are separated from each other according to the abilities of the different metals in the ore to attach themselves to an oily froth. The oily froth is created by a frothing agent which causes water to foam, a collecting agent which forms a film on the gold so that it will stick to air bubbles which rise to the top of the water, and various inorganic chemicals which prevent other metals from filming. Air is forced into the liquid mixture, whereby gold particles are carried to the top in air bubbles and are skimmed off in a froth at the surface.

Amalgamation is a process utilizing a principle that gold tends to form an amalgam (alloy) with mercury. In this process, the gold ore is finely ground and mixed with water to form a pulp which is passed over copper plates coated with mercury. The gold is attracted to and captured by the mercury to form a mercury-gold amalgam. The amalgam is scraped from the copper plates and then heated to boil off the mercury from the gold.

In the cyanidation process, ground ore is placed in a tank containing a weak solution of cyanide. The gold in the solution is precipitated by its contact with metallic zinc. The precipitate is melted and usually cast into gold bars. Cyanidation is dangerous because of the poisonous nature of cyanide vapor.

SUMMARY OF THE INVENTION

The present invention relates to a method of recovering gold from an ore containing micron gold or gold dust. The gold is recovered by providing a silver coated surface, coating the silver coated surface with mercury, washing a mixture of ore and water over the mercury such that an amalgam of gold and mercury is created on the silver coated surface, removing the amalgam from the silver coated surface, and heating the amalgam. The same method may be used to recover platinum from an ore containing micron platinum or platinum dust and also to recover silver from an ore containing micron silver or silver dust.

BRIEF DESCRIPTION OF THE DRAWINGS

The invention will described with reference to the accompanying drawings, wherein.

DESCRIPTION OF A PREFERRED EMBODIMENT

Figure 1:
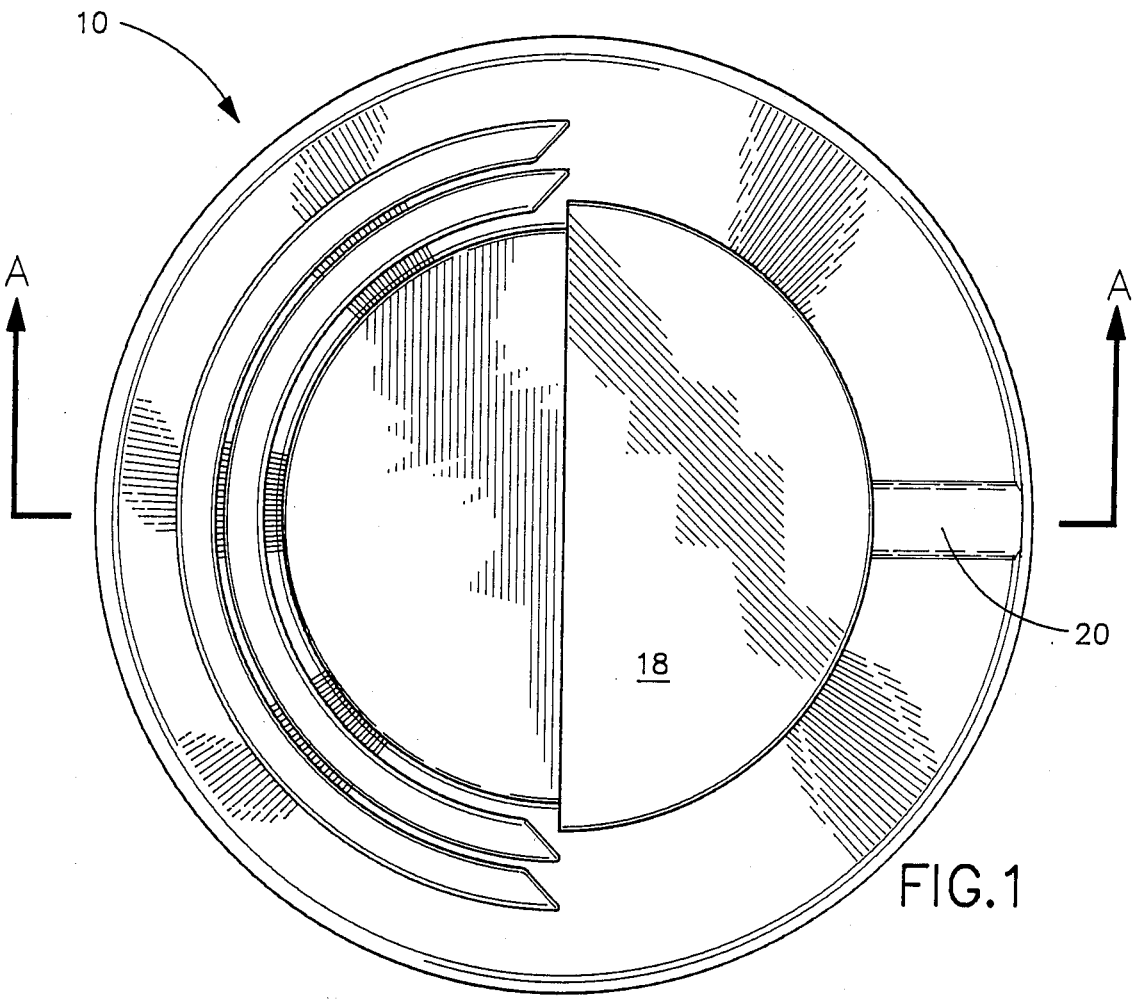
FIG. 1 is a top view of a pan that may be used in the method in accordance with one embodiment of the present invention.
Figure 2:
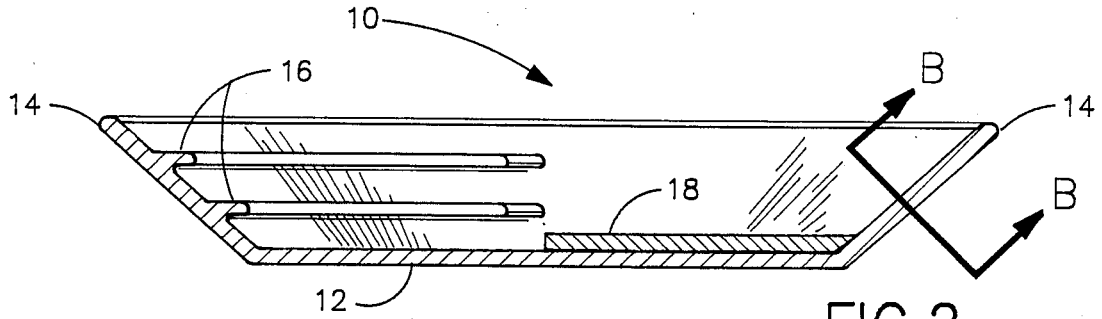
FIG. 2 is a cross sectional view of the pan shown in FIG. 1, taken along the line A—A.

Referring now to the drawings wherein like reference numerals and symbols refer to the same item, there is shown in FIGS. 1 and 2 a pan that may be utilized in the method of the present invention. The pan 10 includes a substantially flat, circular bottom 12 and a side 14 extending upwardly and outwardly from the periphery of the bottom 12. A pair of ribs 16 protrude inwardly from an arcuate portion of the side 14 and generally parallel with the bottom 12.

The inside surface of the bottom 12 of the pan 10 is provided with a silver plate 18. In a preferred embodiment of the present invention, the silver plate 18 is semi-circular and is disposed generally opposite the ribs 16. Where the pan 10 is provided with a metallic bottom 12, the silver plating can be accomplished by coating a portion of the bottom 12 with silver during the pan production process or by applying a fine base of copper to the bottom 12 and then coating the copper with silver during the pan production process. The silver plate, whether silver alone or a copper and silver combination, may be produced by any one of a number of commercially available methods of metal plating. In pans having a non-metallic bottom 12, preferably the silver plate overlays a thin copper layer, and the copper-silver plate is adhered to the pan bottom 12 by a cyano-acrylic or epoxy adhesive.

Figure 3:
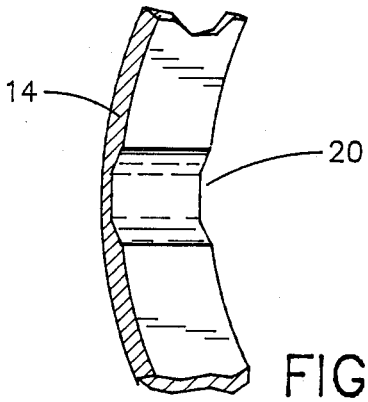
FIG. 3 is a cross sectional view of the pan in FIGS. 1 and 2, taken along the line B—B.

The pan 10 depicted in FIGS. 1, 2 and 3 may be used in the well-known, conventional manner of "panning" for gold while at the same time performing the method of the present invention. In the conventional method of panning, finely ground, particulate ore which the prospector believes contains gold is deposited in the pan along with water. The prospector moves and orients the pan so that the water oscillates and swirls in the pan 10, generally tilting the pan 10 so that the portion of the pan 10 provided with the ribs 16 is relatively low. The turbulence of the water as it swirls carries ore particles. The relatively lighter particles are carried most readily by the water, whereas the heavier particles (presumably most likely to contain gold) have a greater inertia and are more difficult to move with the water. The water carrying particulate matter is gradually spilled from the pan 12, fresh water is poured into the pan, and the water is swirled and then spilled. This process is repeated until relatively heavy ore particles presumably containing gold are left in the pan.

The aforementioned process of "panning" for gold rarely recovers gold dust or so-called "micron" gold which are microscopic bits of free gold invisible to the naked eye. The pan 10 may be used in the conventional "panning" method to recover even micron gold.

In accordance with the present invention, the silver plate 18 is coated with mercury. Such coating may be accomplished by placing a few drops of mercury on the silver plate 18 and by gently rubbing the mercury over the surface of the silver plate 18. The pan 10 is then used in the conventional "panning" method. A relatively stiff brush may be used to agitate the particulate ore to increase the amount of particulate ore being carried by the swirling water. Water bearing micron gold will swirl over the mercury coated silver plate 18, and the gold will become amalgamated with the mercury. As this amalgamation process takes place, a yellow colored film will coat the silver plate 18. The yellow film, which constitutes an amalgamation of mercury and gold, is thereafter removed from the silver plate 18 such as by scraping the amalgamation from the silver plate 18 with a plastic spatula.

The amalgamation is then heated so that the mercury boils and vaporizes, leaving the gold. The amalgamation may be heated within a conventional field retort. Also, the mercury vapor may be distilled in a conventional distilling process so that the mercury is recovered and not introduced into the atmosphere. The excess mercury may be removed from the amalgamation prior to heating by placing the amalgamation in a chamois cloth and wringing the chamois such that the amalgamation is squeezed and mercury penetrates through and drips from the chamois. The amalgamation may also be washed with weak nitric acid prior to being heated. If this acid wash is utilized, the vapors generated by heating the amalgamation are poisonous and should not be inhaled.

The pan disclosed in FIGS. 1, 2 and 3 and the method for recovering gold just described can be used equally advantageously for the recovery of platinum—especially platinum dust or micron platinum—and for the recovery of silver—especially silver dust or micron silver.

It should be readily apparent that the pan 10 may be provided with a bottom 12 which is slightly convex or slightly concave. Also, the pan can comprise a socalled batea, which is a funnel shaped pan commonly used in South America and in the Orient.

To aid in the removal of the amalgamation from the silver plate 18 and from the pan 10, the inside surface of the side 14 of the pan 10 may be provided with an upwardly extending groove 20. One end of the groove 20 is located adjacent to an edge of the silver plate 20, approximately mid-way around the arcuate periphery of the silver plate 20, while the other end of the groove 20 projects through the rim of the side 14. The groove 20 may converge in width and deepen toward the rim of the side 14. The amalgamation may be scraped from the silver plate 18 into the groove 20 and from there may be forced along the groove 20 and channeled into a conventional field retort or other receptacle.

It is to be noted that in the present invention the mercury coats the silver plate and not a copper plate. Mercury reacts with copper in a copper plate thereby causing the copper plate to erode.

The pan and method of the present invention may be utilized by professional prospectors in the field so that they can immediately apprise whether an ore bears gold, platinum or silver. The pan and method of the present invention may also be used by amateur prospectors for the direct purpose of recovering the gold, platinum or silver itself.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than is specifically described above.

I claim:

1. A method of recovering gold from an ore containing micron gold or gold dust comprising the steps of:

providing a surface coated with silver;

coating the silver coated surface with mercury;

providing a liquid comprising water;

washing a mixture of ore and said liquid over the mercury such that an amalgam of gold and mercury is created on the silver coated surface;

removing the amalgam from the silver coated surface;

wrapping the amalgam in a chamois and squeezing the chamois prior to heating the amalgam; and heating the amalgam.

2. A method of recovering gold according to claim 1 comprising the further step of applying the nitric acid to the amalgam prior to heating the amalgam.

3. A method of recovering platinum from an ore containing micron platinum or platinum dust comprising the steps of:

providing a surface coated with silver;

coating the silver coated surface with mercury;

providing a liquid comprising water;

washing a mixture of ore and said liquid over the mercury such that an amalgam of gold and mercury is created on the silver coated surface;

removing the amalgam from the silver coated surface;

wrapping the amalgam in a chamois and squeezing the chamois prior to heating the amalgam; and heating the amalgam.

4. A method of recovering platinum according to claim 3 comprising the further step of applying the nitric acid to the amalgam prior to heating the amalgam.

5. A method of recovering silver from an ore containing micron silver or silver dust comprising the steps of:

providing a surface coated with silver;

coating the silver coated surface with mercury; providing a liquid comprising water;

washing a mixture of ore and said liquid over the mercury such that an amalgam of gold and mercury is created on the silver coated surface;

removing the amalgam from the silver coated surface;

wrapping the amalgam in a chamois and squeezing the chamois prior to heating the amalgam; and heating the amalgam.

6. A method of recovering silver according to claim 5 comprising the further step of applying the nitric acid to the amalgam prior to heating the amalgam.

* * * * *